United States Patent [19]

Darner

[11] Patent Number: 4,785,867

[45] Date of Patent: Nov. 22, 1988

[54] TRAVERSE ROD WITH UNIVERSAL MASTER CARRIER

[75] Inventor: Ronald G. Darner, Fort Atkinson, Wis.

[73] Assignee: Graber Industries, Inc., Middleton, Wis.

[21] Appl. No.: 943,379

[22] Filed: Dec. 16, 1986

[51] Int. Cl.[4] ..... A47H 5/02

[52] U.S. Cl. ..... 160/345; 160/126

[58] Field of Search ..... 160/345, 346, 347, 123, 160/124, 125, 126, 330; 16/87.4 R, 87.6 R, 94 D, 95 D, 96 D

[56] References Cited

U.S. PATENT DOCUMENTS

| | | | |
|---|---|---|---|
| 1,878,526 | 9/1932 | Kenney et al. . | |
| 2,863,505 | 12/1958 | Cameron | 160/345 |
| 3,354,498 | 11/1967 | Salzmann | 16/87.4 R |
| 3,514,806 | 6/1970 | Klein | 160/345 X |
| 3,946,791 | 3/1976 | Brown | 16/87.4 R X |
| 3,951,197 | 4/1976 | Cohen et al. | 160/346 |
| 3,978,904 | 9/1976 | Riebock et al. | 160/345 |
| 4,301,852 | 11/1981 | Comeau | 160/126 X |
| 4,355,677 | 10/1982 | Madsen | 160/126 |
| 4,438,798 | 3/1984 | Ford et al. | 160/126 |

*Primary Examiner*—Robert W. Gibson, Jr.
*Assistant Examiner*—David M. Purol
*Attorney, Agent, or Firm*—Vernon J. Pillote

[57] ABSTRACT

A traverse rod having a lengthwise extending slot at the bottom and forward and rear guide rails along opposite sides of the slot. A master carrier is movable along the rod and includes a carrier body having first and second carrier guide heads extending laterally from opposite sides of the carrier body and the carrier body is adapted to be reversibly mounted in the rod with the first carrier guide head guidably engaging either the forward or the rear guide rail on the rod. A cord engaging means is provided on the first carrier guide head for supporting a traverse cord at a location laterally offset from one side of the carrier body. An elongated arm support bracket is detachably and reversibly mounted on the carrier body so that the arm support bracket can be selectively positioned at either side of the carrier body. A drapery support arm is detachably and reversibly mounted on the arm support bracket so that it can extend from either end thereof.

17 Claims, 2 Drawing Sheets

Fig. 2.
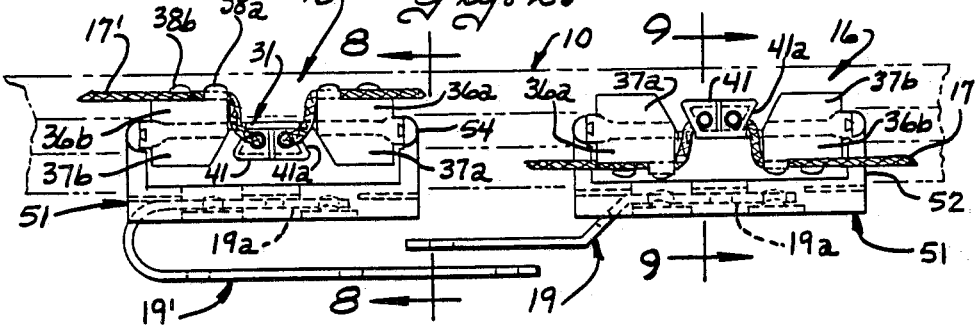
Fig. 3.
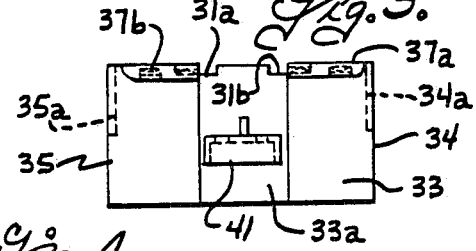
Fig. 5.
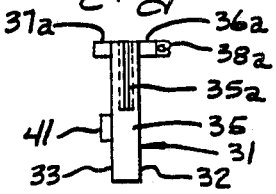
Fig. 4.
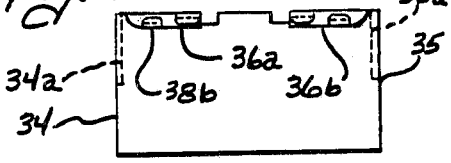
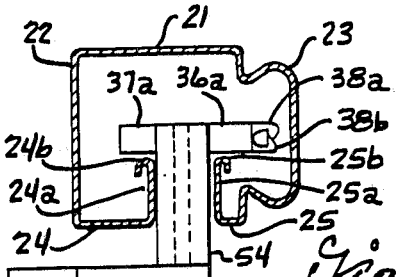
Fig. 8.
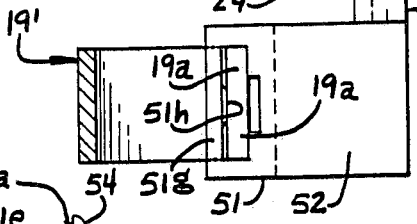
Fig. 6.
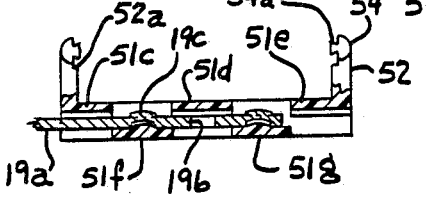
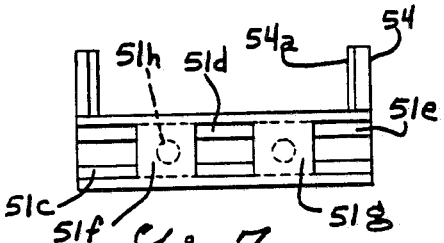
Fig. 7.
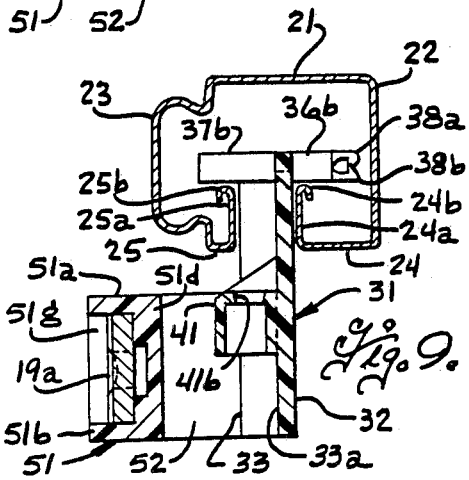
Fig. 9.

TRAVERSE ROD WITH UNIVERSAL MASTER CARRIER

BACKGROUND OF THE INVENTION

The present invention relates to traverse rods of the type having a downwardly opening slot in the bottom of the rod and to master carriers therefor. In U.S. Pat. Nos. 1,878,526 and 2,863,505, the master carriers are formed with a carrier body that is guidably supported on the rod and which extends downwardly through the slot in the bottom of the rod and has a drapery support arm that is integral with the carrier body. It is desirable in many drapery installations to support the drapery at the front side of the rod so that the drapery conceals the rod from view when the drapery is closed. If the master carrier is formed with integral drapery support arms, then it is necessary to make different left and right master carriers, if both master carriers are to support the respective drapery panel at the front side of the rod. It is also known, as disclosed in U.S. Pat. No. 3,514,806, to make a traverse rod having two downwardly opening slots in the bottom of the rod separated by an inverted T-shaped rail, with master carriers that can be reversibly mounted on the rail and having detachable drapery support arms such that the same carrier body can be used for either the left or right master carrier. The master carrier construction disclosed in that patent is such that it requires a very wide carrier body which extends to the front side of the rod when it is mounted for either left or right draw.

SUMMARY OF THE INVENTION

It is an object of the present invention to provide a traverse rod of the type having a lengthwise extending slot in the bottom and guide rails along opposite sides of the slot, with an improved master carrier that can be assembled in the rod for either front or rear cord positions and which can be adapted for right, left or split draw drapery installations.

Accordingly, the present invention provides a traverse rod of the type having a lengthwise extending slot at the bottom and forward and rear guide rails along opposite sides of the slot and at least one master carrier movable along the rod with a traverse cord for moving the master carrier along the rod. The master carrier comprises a carrier body having first and second sides and adapted to be received between the forward and rear carrier guide rails, the carrier body having a first carrier guide means extending laterally from the first side of the body and the second carrier guide means extending laterally from the second side of the body and the carrier body being adapted to be selectively and reversibly mounted in the rod with the first carrier guide means guidably engaging either the forward or the rear carrier guide rail. An elongated arm support bracket is detachably and reversibly mounted on the master carrier body with the arm support bracket selectively positioned at either the first side or the second side of the master carrier body. A drapery support arm is detachably and reversibly mounted on the arm support bracket.

A cord engaging means is provided on the first carrier guide means for supporting a traverse cord at a location laterally offset from one side of the carrier body so that the master carrier body will support the traverse cord at the front side of the slot when the carrier body is assembled in the rod with the first carrier guide engaging the front rail, and the carrier body will support the cord at the rear side of the slot when the carrier body is assembled in the rod with the first carrier guide engaging the rear guide rail. The arm support bracket is detachably and reversibly mounted on the body so that it can be positioned at either the first or the second side of the body to thereby enable locating the arm support bracket at the front side of the rod in either position of the carrier body. The drapery support arm is detachably and reversibly mounted on the arm support bracket so that it can extend from either end of the arm support bracket.

BRIEF DESCRIPTION OF THE DRAWINGS

FIG. 2 is a plan view of a pair of master carriers mounted in a traverse rod with the traverse rod shown in phantom lines;

FIG. 3 is a side view of one side of the master carrier body;

FIG. 4 is a side view of the other side of the master carrier body;

FIG. 5 is an end view of the master carrier body;

FIG. 6 is a top view of an arm support bracket and drapery support arm with parts broken away and shown in section;

FIG. 7 is a front elevational view of the arm support bracket;

FIG. 8 is a transverse sectional view through the rod taken on the plane 8—8 of FIG. 2 and illustrating the parts on a larger scale than FIG. 2; and FIG. 9 is a transverse sectional view through the traverse rod taken on the plane 9—9 of FIG. 2 and illustrating the parts on a larger scale than FIG. 2.

DETAILED DESCRIPTION

Figure 1:
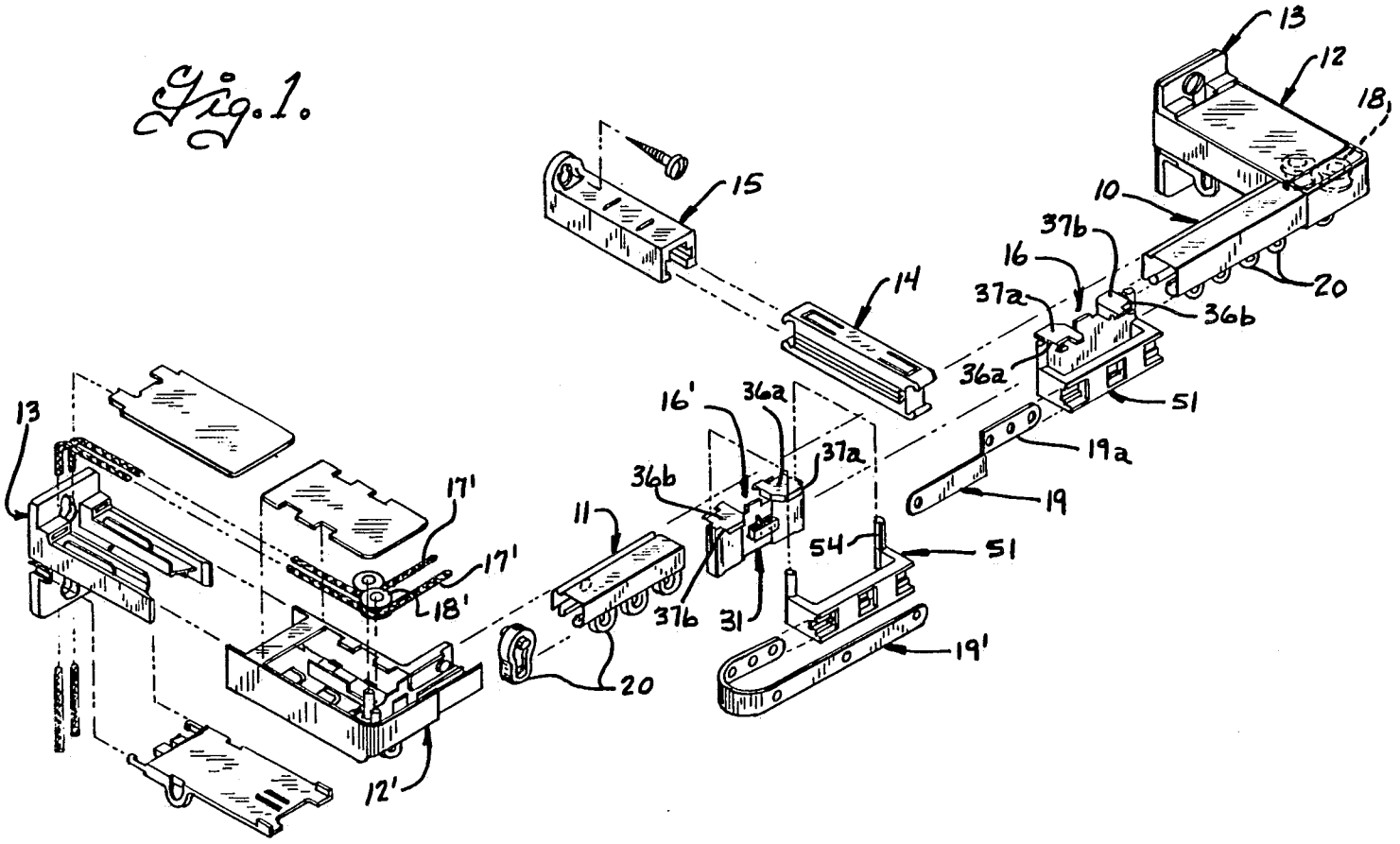
FIG. 1 is a perspective view of a traverse rod assembly embodying the present invention.

Reference is now made more specifically to FIG. 1 of the drawing wherein there is illustrated a traverse rod assembly embodying the present invention. In general, the adjustable traverse rod assembly is of the type having a downwardly opening slot in the bottom thereof and includes an outer rod 10 and an inner rod 11 telescopically receivable in the outer rod. Pulley housings 12 and 12' are provided at opposite ends of the traverse rod assembly and the pulley housings are supported on mounting brackets 13 adapted for attachment to a supporting surface such as a wall, window frame or the like. One or more intermediate rod engaging brackets 14 are provided for engaging the rod assembly intermediate its ends and the intermediate rod engaging bracket is mounted on an intermediate support bracket 15 adapted for attachment to a supporting surface. One or more master carriers, herein shown two in number and designated 16, 16' are mounted for movement along the rod assembly and the master carriers are operated by traverse cords having runs 17, 17' extending lengthwise of the rod assembly and entrained over pulleys 18, 18' in the pulley housings 12 and 12' respectively. The traverse cords are operatively connected to the master carriers to effect movement of the master carriers along the rod assembly and the master carriers 16 and 16' have drapery support arms 19, 19' for supporting the lead edge of a respective drapery panel. A plurality of auxiliary drapery carriers 20 are also supported in the rod assembly to support the drapery panels at locations intermediate the master carrier and the pulley housings at the ends of the rod assembly.

The outer and inner hollow rods 10 and 11 are of the type having a downwardly opening slot in the bottom and, as best shown in FIGS. 8 and 9, each includes a top wall 21, front wall 22, rear wall 23 and forward and rear bottom walls 24 and 25 that are spaced apart to define a downwardly opening slot at the bottom of the rod. The forward bottom wall 24 extends rearwardly from the lower edge of the front wall 22 and has a forward guide rail 24*a* extending upwardly along one side of the slot and terminating in an upper guide edge 24*b*. The rear bottom wall 25 has a rear rail 25*a* extending upwardly from the forward edge of the rear wall 25 and which terminates in an upper guide edge 25*b*. The inner rod 11 is formed generally complementary to the outer rod and has an outer cross section sufficiently smaller than the outer rod to be telescopically receivable therein.

In traverse rods of the type having a slot in the bottom wall, and particularly in rods having a small cross sectional size, it is desirable to route the traverse cords so that one run is disposed forwardly of the slot in the bottom wall of the rod and the other runs disposed rearwardly of the slot in the bottom wall to prevent the traverse cords from drooping out of the slot in the rod and to also minimize interference between the runs of the traverse cord and the master carriers as they move in relatively opposite directions along the rod.

The master carriers 16 and 16' each include a carrier body 31. As described more fully hereinafter, the carrier body 31 is the same for both master carriers 16, 16' and the carrier body is adapted to be selectively and reversibly mounted in the rod in a manner such that one master carrier guides one run 17' of the traverse cord along the rear side of the slot in the rod and the other master carrier guides the other run 17 of the traverse cord along the front side of the slot in the rod. The carrier body 31 has first and second sides respectively designated 32 and 33 and first and second ends respectively designated 34 and 35. The carrier body has a maximum thickness measured between the sides 32 and 33, at least adjacent of the upper portion of the body, which is slightly less than the spacing between the front and rear guide rails 24*a* and 25*a* of the rod so that the carrier body is adapted to be received between the front and rear guide rails as best shown in FIGS. 8 and 9. The carrier body preferably has a generally rectangular configuration as viewed from the side and carrier guide means are provided at the upper side of the carrier body for engaging and supporting the carrier body on the upper edges of the guide rails. More particularly, the carrier body has a first pair of carrier guide heads designated 36*a* and 36*b* that extend laterally from the first side 32 of the carrier body, and a second pair of carrier guide heads 37*a* and 37*b* that extend laterally from the second side 33 of the carrier body. The carrier body is conveniently formed by molding of a suitable rigid plastic and the carrier guide heads 36*a*, 36*b* and 37*a*, 37*b* are molded integrally with the carrier body 31. Cord engaging means are provided on each of the first carrier guide heads 36*a*, 36*b* for supporting a traverse cord at a location laterally offset from the side 32 of the carrier body. In the embodiment shown, the cord guide means on each carrier guide head comprises an upper hook member 38*a* and a lower hook member 38*b* spaced apart in a direction lengthwise of the carrier body and arranged to have a run of the traverse cord passed over the lower hook and under the upper hook as shown in FIG. 2. As previously described, the carrier body is preferably molded of a rigid plastic and the hook members 38*a* and 38*b* are molded integrally with the respective carrier guide heads 36*a* and 36*b*. The carrier body is designed to be reversibly mounted in the rod. Thus, the carrier body for one of the master carriers such as 16 can be mounted in the rod with the first carrier guide means 36*a*, 36*b* engaging the front rail 24*a* of the rod as shown in FIG. 9 and at the right hand side in FIG. 2, whereby the cord engaging means 38*a*, 38*b* supports the run 17 of the traverse cord in the rod at a location forwardly of the slot in the rod. The carrier body of the other master carrier 16' can be mounted in the rod with the carrier guide heads 36*a*, 36*b* engaging the rear rail 24*a* of the rod as shown in FIG. 8 and at the left in FIG. 2, whereby the cord engaging means 38*a*, 38*b* support the other run 17' of the traverse cord in the rod at a location rearwardly of the slot in the rod.

The carrier body 31 has a lower portion that extends below the bottom of the rod as shown in FIGS. 8 and 9 and a cord lock 41 is provided on the lower portion of the carrier body. The cord lock 41 is conveniently molded integrally with the carrier body and is preferably disposed at the second side 33 of the carrier body and at a location approximately medially between the ends of the body. The upper edge of the carrier body is notched as indicated at 31*a* and 31*b* in FIGS. 3 and 4 and the side 33 is formed with a vertically extending recessed area 33*a* that extends from the top to the bottom of the carrier body, as best shown in FIGS. 3 and 9. With this arrangement the traverse cord can be routed from the adjacent ends of the cord guides on the heads 36*a*, 36*b* generally horizontally through the notches 31*a*, 31*b* in the top of the carrier body and then downwardly through the recessed area 33*a* at the second side of the carrier body to the cord lock 41. The cord lock is arranged so that it can be used to anchor either a continuous cord intermediate its ends, or two ends of a traverse cord. The cord lock extends laterally from the recessed area 33*a* and, as shown in FIG. 2, has ends 41*a* that converge in a direction toward the recessed area 33*a* of the carrier body at an acute angle and such that, when an intermediate loop of the traverse cord is drawn down below the cord lock as shown at the right hand side in FIG. 2, the intermediate portion of the traverse cord will be effectively locked against movement relative to the master carrier body. The cord lock is also provided with a pair of spaced holes 41*b* intermediate its ends and through which the end portions of a traverse cord can be threaded as shown at the left hand side in FIG. 2, and the traverse cords thereafter knotted below the cord lock to anchor the ends of the run of the traverse cord to the master carrier.

The master carriers 16 and 16' also include an elongated arm support bracket which is detachably and reversibly mounted on the carrier body 31 so that it can be selectively positioned at either the first side 32 or the second side 33 of the carrier body. The arm support bracket 51 is conveniently formed of rigid plastic and is the same for both master carriers 16, 16' and like numerals are used to designate the same parts. The elongated arm support bracket has laterally extending mounting portions 52 adjacent opposite ends and means are provided for detachably and reversibly connecting the laterally extending mounting portions 52 to the carrier body 31. More particularly, the ends 34, 35 of the carrier body are formed with dovetailed shaped grooves designated 34*a*, 35*a* respectively that are open at their upper ends and which terminate at their lower ends at a location spaced above the bottom of the carrier body as best shown in FIG. 5. The laterally extending mounting portions 52 of the arm support bracket have upwardly extending portions 54 on their inner ends and these upwardly extending portions have dovetailed shaped keys 54*a* which are adapted to be received in the grooves 34*a*, 35*a*. The arm support brackets can be assembled onto the carrier bodies prior to mounting the master carriers in the rod by sliding the keys 54 downwardly in the keyways 34*a*, 35*a* and, when the keys engage the lower ends of the slots, further downward movement of the arm support bracket relative to the slide body is limited. The rear ends of the mounting portions 52 are shaped to slide along the end faces 34, 35 of the slide body during assembly of the arm support bracket on the slide body and the mounting portions have a rearwardly facing shoulder shown at 52*a* in FIG. 6, which engages a side face of the carrier body adjacent the ends of the carrier body. Thus, the arm support bracket can be mounted on one of the slide bodies such as the master carrier 16 so that the elongated arm support bracket is positioned at the first side 32 of the carrier body, and the arm support bracket for the other master carrier 16' can be mounted on the carrier body so as to be positioned at the second side 33 of the slide body. This enables the arm support bracket to be located at the front side of the rod when the carrier body is mounted in either position on the rod.

The arm support bracket 51 is constructed and arranged to detachably and reversibly support either of the drapery support arms 19, 19'. In the preferred embodiment illustrated, the drapery support arms are formed from a metal bar of generally rectangular cross section and the drapery support arms 19, 19' each have an elongated generally straight mounting shank portion 19*a* of like configuration at one end. In the embodiment illustrated one of the drapery support arms 19 is an underlap arm and the other drapery support arm 19' is an overlap arm arranged to overlap the arm 19, when the drapery carriers are in their closed position. As is conventional, each drapery support arm has a plurality of openings for receiving drapery hooks.

The elongated arm support brackets 51 are constructed and arranged to form a guide passage opening at opposite ends of the arm support bracket for guidably receiving the mounting shank portion of a drapery support arm when the shank is inserted into the passage from either end of the arm support bracket. For this purpose, the elongated arm support brackets each have lengthwise extending upper and lower wall portions 51*a*, 51*b*, a plurality of rear wall portions 51*c*, 51*d* and 51*e* that extend between the upper and lower wall portions at spaced locations therealong, and a plurality of forward wall portions herein shown two in number and designated 51*f* and 51*g* that extend between the upper and lower wall portions at spaced locations therealong and which are spaced forwardly of the rear wall portion and in staggered relation to the rear wall portions to define a guide passage that opens at opposite ends of the elongated arm support bracket 51. Means are provided for releasably retaining the mounting shank portion in a lengthwise adjusted position in the guide passage. As best shown in FIG. 6, detents in the form of rounded protrusions 51*h*, are provided on at least some of the wall portions 51*f* and 51*g* and arranged to project into recesses 19*b* in the shank portion of a drapery support arm, to releasably retain the drapery support arm in a lengthwise adjusted position along the guide passage on the arm support bracket. The recesses 19*b* can be in the form of openings that extend through the shank portion 19*a* of the drapery support arms. Alternatively, one or more of the recesses can be an incompletely punched opening that forms a depression at one side of the shank portion and a protuberance at the other side as shown at 19*c* in FIG. 6. The protuberance or protuberances 19*c* are arranged to engage one of the rear portions 51*c*–51*e* to aid in releasably retaining the shank portion in different adjusted positions along the guide passage. As will be seen, the mounting shank portions 19*a* of either drapery support arm 19, 19' can be inserted into the guide passage in the arm support bracket on either master carrier and from either end thereof. Thus, the overlap and underlap arms can be mounted on either o the master carriers 16, 16' and can extend from either end of the master carrier. Alternatively, the drapery support arms can be of the "butt" type drapery support arms in which the drapery support portion extends transverse to the mounting shank portion and crosswise of the rod at a level below the underside of the rod, or a pair of underlap arms used in opposition for centrally hung curtains.

From the foregoing it is thought that the construction and use of the traverse rod and master carrier construction will be readily understood. The master carrier body and arm support bracket are molded of a suitable rigid plastic, for example glass or fiber reinforced acetal, and the drapery support arms are formed of metal. The master carrier bodies can be reversibly positioned in the downwardly opening slot in the traverse rod so that one master carrier supports a traverse cord 17 in the rod forwardly of the slot and the other master supports a traverse cord 17' in the rod rearwardly of the slot. The arm support bracket 51 is detachably and reversibly mounted on the carrier body so that it can be positioned at either side of the carrier body. Thus, the arm support brackets on both master carriers can be located adjacent the front of the rod even though one of the carrier bodies is reversed. The drapery support arms have shank portions that are detachably and reversibly mounted in the elongated arm support bracket. Accordingly, when overlap and underlap type drapery support arms are used, each drapery support arm can be mounted on either of the master carriers and can be arranged to extend from either end thereof. Further, the shank portion of each drapery support arm is slidable in the guideway of the arm support bracket and the detents are operative to hold the arm in an adjusted position, to adjust the lengthwise position of the drapery support arm relative to the respective master carrier.

The arm support brackets and drapery support arms further serve to conceal the knots or loops of the cords from view.

The embodiments of the invention in which an exclusive property or privilege is claimed are defined as follows:

1. A traverse rod including a hollow rod having a lengthwise extending slot at the bottom thereof, forward and rear carrier guide rail means along opposite sides of the slot having upper carrier guide edges, at least one master carrier movable along the rod, and means including a traverse cord for moving the master carrier along the rod, the master carrier comprising a carrier body having first and second sides and adapted to be received between the forward and rear carrier guide rail means, the carrier body having first carrier guide means extending laterally from the first side of the carrier body and second carrier guide means extending laterally from the second side of the carrier body, the carrier body being adapted to be selectively and reversibly mounted in the rod with the first carrier guide means guidably engaging the upper guide edge on either the forward or the rear carrier guide rail means, cord engaging means on the first carrier guide means for supporting the traverse cord at a location laterally offset from said first side of the carrier body, an elongated arm support bracket, means for detachably and reversibly mounting the arm support bracket on the carrier body with the elongated arm support bracket selectively positioned at either the first side or the second side of the carrier body, a drapery support arm, and means for detachably and reversibly mounting the drapery support arm on the arm support bracket.

2. A traverse rod according to claim 1 including at least two of said master carriers mounted for movement along the rod and relative to each other with the first carrier guide means on one of the master carrier bodies engaging the front guide rail means and with the first carrier guide means on the other of the master carrier bodies engaging the rear guide rail means.

3. The combination of claim 1 wherein said carrier body has a lower portion extending below the bottom of the rod and cord lock means on said lower portion.

4. The combination of claim 1 wherein said first carrier guide means includes at least two guide heads spaced apart in a direction lengthwise of the rod and each having said cord engaging means for engaging and supporting a traverse cord at a location laterally offset from said side of the master carrier body.

5. The combination of claim 3 wherein said cord lock means extends laterally from said second side of the master carrier body.

6. A traverse rod according to claim 1 wherein said elongated arm support bracket has integral mounting portions extending laterally therefrom adjacent said opposite ends, said means for selectively and reversibly mounting the arm support bracket being constructed and arranged to detachably engage said mounting portions of the arm support bracket.

7. A traverse rod according to claim 1 wherein said master carrier body has first and second ends, said elongated arm support bracket has first and second integral mounting portions extending laterally therefrom adjacent said opposite ends thereof, said means for selectively and reversibly mounting the arm support bracket including interengaging means on said first and second ends of said master carrier body and said first and second mounting portions of said arm support bracket.

8. A traverse rod according to claim 1 wherein said drapery support arm has an elongated mounting shank, said arm support bracket having guide passage means opening at said opposite ends of said arm support bracket for guidably receiving said mounting shank when it is inserted into the passage means from either end of the arm support bracket, and interengaging detent means on the mounting shank and arm support bracket for releasably retaining the mounting shank of the drapery support arm against endwise movement relative to the arm support bracket.

9. A traverse rod according to claim 1 wherein said drapery support arm has an elongated mounting shank, said elongated arm support bracket having upper and lower lengthwise extending wall portions and forward and rear wall portions extending in staggered relation between the upper and lower wall portions and defining a guide passage opening at said opposite ends of the arm support bracket for guidably receiving said mounting shank when it is inserted into the passage means from either end of the arm support bracket, and interengaging detent means on the mounting shank and arm support bracket for releasably retaining the mounting shank against endwise movement relative to the arm support bracket.

10. A traverse rod including a hollow rod having a lengthwise extending slot at the bottom thereof, forward and rear carrier guide rail means along opposite sides of the slot, at least one master carrier movable along the rod, and means including a traverse cord for moving the master carrier along the rod, the master carrier comprising a master carrier body having first and second sides and opposite ends, the master carrier body having a first pair of carrier guide means extending laterally from said first side of the carrier body and a second pair of carrier guide means extending laterally from said second side of the carrier body, the carrier body being adapted to be selectively and reversibly mounted in the rod with the first pair of carrier guide means guidably engaging either the forward or the rear carrier guide rail means, an elongated arm support bracket having opposite ends and first and second mounting portions extending laterally from one side thereof adjacent said opposite ends of the arm support bracket, interengaging generally vertical tongue and groove means on said first and second mounting portions and on said opposite ends of said master carrier body for detachably and reversibly mounting the arm support bracket on the master carrier body with the arm support bracket selectively positioned at either the first side or the second side of the master carrier body, a drapery support arm, and means for selectively and reversibly mounting the drapery support arm on the arm support bracket.

11. A traverse rod according to claim 10 including cord guide means on said first pair of carrier guide means for supporting the traverse cord at a location laterally offset from the first side of the carrier body.

12. A traverse rod according to claim 11 wherein the master carrier body has a lower portion extending below the rod, and cord lock means on said lower portion.

13. A traverse rod according to claim 11 wherein said master carrier body has cord lock means at said second side of the body at a level below said rod.

14. A traverse rod according to claim 10 wherein said drapery support arm has an elongated mounting shank and a drapery support portion extending from one end of said mounting shank, the arm support bracket having guide passage means adapted to receive the mounting shank of the drapery support arm when it is inserted into the passage means from either end of the arm support bracket, and interengaging detent means on the mounting shank and guide passage means for releasably retaining the shank of the drapery support arm against endwise movement relative to the arm support bracket.

15. A traverse rod according to claim 11 at least two of said master carriers mounted for along the rod and relative to each other with first carrier guide means on one of the master engaging the front rail means and with the carrier guide means on the other of the master carrier bodies engaging the rear guide rail means.

16. A traverse rod according to claim 10 said drapery support arm has an elongated mounting said elongated arm support bracket having upper and lower lengthwise extending wall portions and forward rear wall portions extending in staggered relation between the upper and lower wall portions and defining a passage opening at said opposite ends of the arm support bracket for guidably receiving said mounting shank when it is inserted into the passage means from either end of the arm support bracket, and interengaging detent means on the mounting shank and arm support bracket for releasably retaining the mounting shank against endwise movement relative to the arm support bracket.

17. A traverse rod including a hollow rod having a lengthwise extending slot and guide rail means along opposite sides of the slot, at least one master carrier movable along the rod, means including a traverse cord for moving the master carrier along the rod, the master carrier comprising a master carrier body having carrier guide means guidably engaging said guide rail means, an elongated horizontal arm support bracket on the master carrier body, a drapery support arm having an elongated mounting shank, said elongated arm support bracket having upper and lower lengthwise extending wall portions and a plurality of forward wall portions and a plurality of rear wall portions extending in staggered relation between the upper and lower wall portions and defining a guide passage opening at said opposite ends of the arm support bracket for guidably receiving said mounting shank when it is inserted into the passage means from either end of the arm support bracket, and interengaging detent means on the mounting shank and on at least one of the items comprising the forward and rear wall portions of the arm support bracket for releasably retaining the mounting shank in at least several different lengthwise adjusted positions relative to the arm support bracket.

* * * * *

UNITED STATES PATENT AND TRADEMARK OFFICE

CERTIFICATE OF CORRECTION

PATENT NO. : 4,785,867

DATED : November 22, 1988

INVENTOR(S) : Ronald G. Darner

It is certified that error appears in the above-identified patent and that said Letters Patent are hereby corrected as shown below:

Claim 15, column 8, line 60, insert -- including -- after "11";

line 61, insert -- movement -- after "for";

line 63, insert -- carrier bodies -- after "master";

line 64, insert -- first -- after "the" (first occurrence);

Claim 16, column 8, line 66, insert -- wherein -- after "10";

line 67, insert -- shank,-- after "mounting";

column 9, line 3, insert -- guide -- after "a".

Signed and Sealed this

Twenty-eighth Day of March, 1989

*Attest:*

DONALD J. QUIGG

*Attesting Officer*

*Commissioner of Patents and Trademarks*